United States Patent [19]

DeWitt et al.

[11] Patent Number: 5,052,168

[45] Date of Patent: Oct. 1, 1991

[54] METHOD AND APPARATUS FOR SPREADING OPEN ENVELOPES

[75] Inventors: Robert R. DeWitt, Marlton; Michael E. York, Gibbsboro, both of N.J.

[73] Assignee: Opex Corporation, Moorestown, N.J.

[21] Appl. No.: 475,219

[22] Filed: Feb. 5, 1990

[51] Int. Cl.[5] ..... B65B 43/30

[52] U.S. Cl. ..... 53/492; 53/381.3; 53/381.6

[58] Field of Search ..... 53/492, 386, 384, 381 R, 53/569, 266 A, 391, 390, 381.6, 381.5, 386.1, 381.3

[56] References Cited

U.S. PATENT DOCUMENTS

| | | | |
|---|---|---|---|
| 3,979,884 | 9/1976 | Russell | 53/386 X |
| 4,110,958 | 9/1978 | Stevens | 53/381 R X |
| 4,271,656 | 6/1981 | Russell | 53/386 X |
| 4,388,793 | 6/1983 | Künne | 53/381 R |
| 4,893,454 | 1/1990 | Russell | 53/492 |
| 4,934,892 | 6/1990 | Smith et al. | 53/386 X |

*Primary Examiner*—James F. Coan

*Attorney, Agent, or Firm*—Weiser & Stapler

[57] ABSTRACT

Operations associated with the reciprocating suction arms of a mail extraction device are modified to prevent bleed through from occurring as the opposing faces of an envelope are spread open by the reciprocating arms by drawing an air flow through the suction arms which is sufficient to draw the envelope faces to the suction arms without necessitating their contact with the envelope, and each other. This may be achieved using a vacuum pump of increased output, or by developing a burst in air flow drawn by the suction arms, at an appropriate point just prior to their closure.

18 Claims, 2 Drawing Sheets

FIG. 3
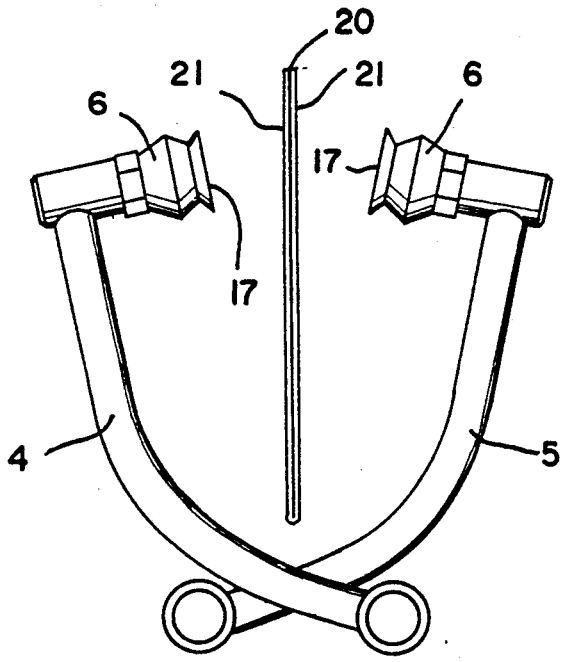
FIG. 4
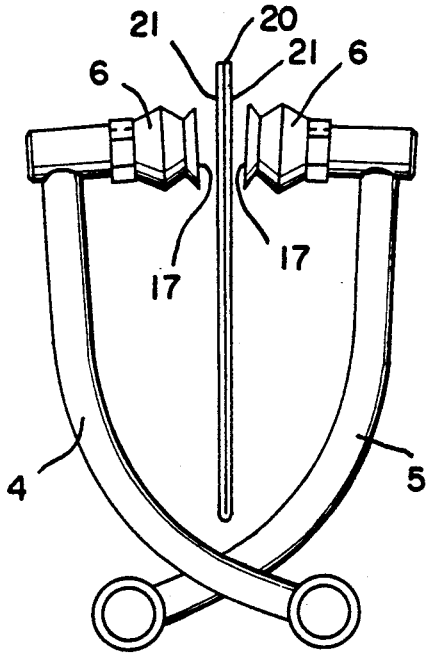
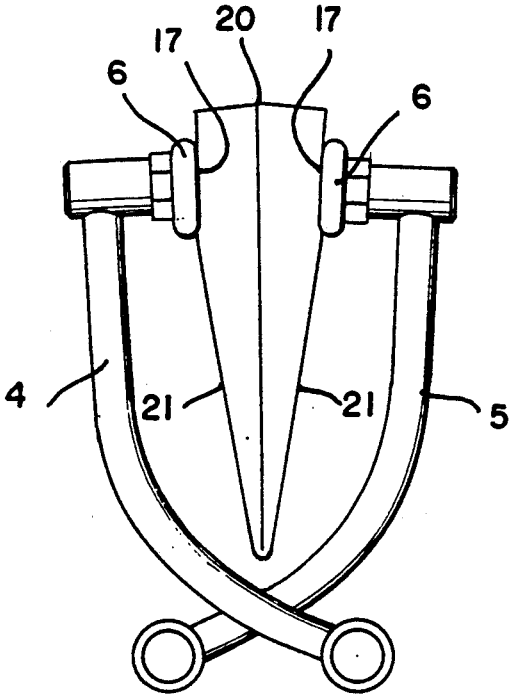
FIG. 5
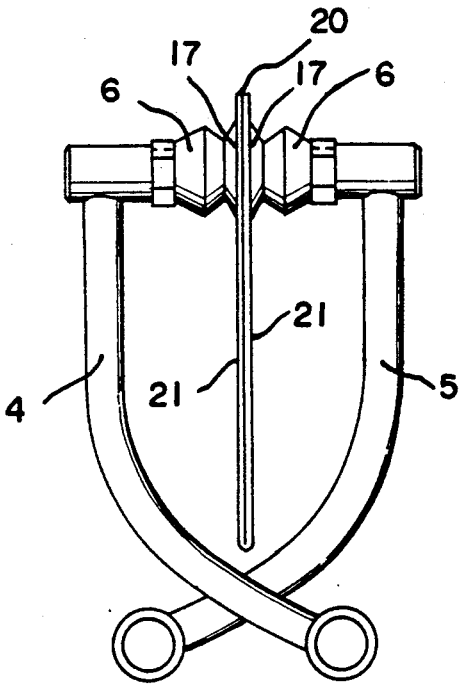
FIG. 6

METHOD AND APPARATUS FOR SPREADING OPEN ENVELOPES

BACKGROUND OF THE INVENTION

The present invention relates generally to the field of mail extraction, and in particular, to certain improvements in mail extraction devices which make use of opposing suction cups to engage and spread apart envelope faces to gain access to contents of the envelope.

A variety of devices have been developed to facilitate the mail extraction process, in which large quantities of envelopes are automatically opened to gain access to their contents. One example of this is the "Rapid Extraction Desk" manufactured by Opex Corporation of Moorestown, N.J., an exemplary model of which is illustrated in U.S. Pat. No. 3,979,884 (Re 32,328).

In their overall operation, these machines are used to receive a series of envelopes which are first sequentially delivered to a device for severing (cutting open) one or more envelope edges, and which are then sequentially delivered to an extraction area for access by the machine's operator. At the extraction area, steps are taken to spread apart the opposing faces of the envelope, permitting the operator to gain access to the contents of each envelope for extraction. The emptied envelope is then released from the extraction area, and is preferably then checked to make sure that the envelope has been emptied of all of its contents.

Although other approaches have been used (such as the early "vacuum box" systems which were marketed by the Bell and Howell Company), a preferred means for spreading open the opposing faces of an envelope involves the use of opposing suction cups mounted to a pair of arms which are movable toward and away from the envelope to be opened, in controlled fashion. This approach has been found to be beneficial in ensuring that each of the series of envelopes to be opened is effectively engaged (and opened) at the operator's extraction station. This is because reciprocating suction cups can operate to positively engage the opposing faces of the envelope resulting from their direct contact with the envelope's faces.

While this approach operates to ensure that each envelope is effectively spread apart at the operator's extraction station, this has also been found to at times contribute to a condition known as "bleed through", which causes contents of the envelope to stick to the inside of one or the other of the envelope's faces. This is because following contact of the opposing suction cups with the envelope's faces, the applied vacuum can at times bleed through the somewhat porous paper which forms the envelope, also entraining contents of the envelope. This can be troublesome in that the operator is then presented with a certain degree of difficulty in separating the entrained contents from the opened envelope, either slowing the extraction process, or at times causing a document to be missed entirely.

Recognizing this problem, efforts have been made to overcome the adverse affects of bleed through. One such approach is disclosed in U.S. Pat. No. 4,110,958. Described is a configured suction cup having a contoured face which imparts a localized curvature to the engaged face of the envelope to create a space between the engaged face of the envelope and any document which might have become stuck to it. This then provides an open area which permits the operator to readily detect, and grasp the contents of the opened envelope, overcoming the disadvantages of bleed through. Yet another approach is disclosed in U.S. Pat. No. 4,388,793. Described is a mechanism which, in addition to spreading apart the opposing faces of an envelope, also produces a lateral shift of the respective faces relative to one another, to once gain create a localized curvature which operates to separate documents contained by the envelope from the adjacent envelope faces. However, the former approach has proved to be somewhat less than satisfactory, and the latter approach requires a relatively complicated mechanism to achieve its end result.

It therefore became desirable to develop a more effective means for overcoming the disadvantages of bleed through, to further facilitate the extraction of contents from their respective envelopes.

SUMMARY OF THE INVENTION

It is therefore the primary object of the present invention to provide a means for preventing bleed through, which might come to compromise the efficiency of a mail extraction process.

It is also an object of the present invention to provide a means for preventing bleed through which is as simple and fail-safe as is possible.

It is also an object of the present invention to provide a means for preventing bleed through which is well adapted to the remaining components of a mail extraction device.

These and other objects are achieved in accordance with the present invention by modifying some of the basic operations associated with the reciprocating suction arms of the mail extraction device to prevent bleed through from occurring as the opposing faces of an envelope are spread open by the reciprocating arms. This then eliminates the need to have to take measures to thereafter separate entrained contents from the adjacent envelope faces which might otherwise have come to engage them.

Generally speaking, this is accomplished by taking steps to draw the opposing faces of an envelope to the suction cups which are fitted to the ends of the suction arms, without requiring closure of the suction arms over the envelope which is to be opened. This has the advantage of providing a positive engagement of the envelope's faces, without requiring the direct contact (between the suction cups and the envelope's faces) which had previously been required for this purpose, and which then contributed to the potential for bleed through to occur.

One means which may be employed for accomplishing this is to significantly increase the flow of air drawn by the suction cups, by increasing the output (size) of the vacuum pump associated with the mail extraction device. This operates to create a low pressure area adjacent to each of the envelope's faces which is sufficient to positively draw the faces of the envelope to the adjacent suction cups, prior to closure of the suction arms. Yet another means which may be employed for accomplishing this is to monitor advancement of the suction arms and, at an appropriate point just prior to their closure, to then establish the air flow which needs to be drawn by the suction cups associated with the suction arms. This "burst" in air flow has been found to be equally beneficial in drawing the envelope faces to the suction cups without also entraining contents of the envelope. What is more, this can be achieved without requiring an increase in the size of the vacuum pump which is used.

In either case, such modifications serve to effectively engage opposing envelope faces while also effectively eliminating the disadvantages of bleed through, leaving the contents free for engagement by the operator at the extraction station. Moreover, these modifications are easily adapted to existing suction-arm-type mail extraction devices.

For further detail regarding a preferred embodiment suction arm assembly produced in accordance with the present invention, reference is made to the description which is provided below, taken in conjunction with the following illustrations.

BRIEF DESCRIPTION OF THE DRAWINGS

FIGS. 3 through 6 are partial, side elevational views of the suction arms, in different operating positions.

In the several views provided, like reference numbers denote similar structure.

DETAILED DESCRIPTION OF THE PREFERRED EMBODIMENT

Figure 1:
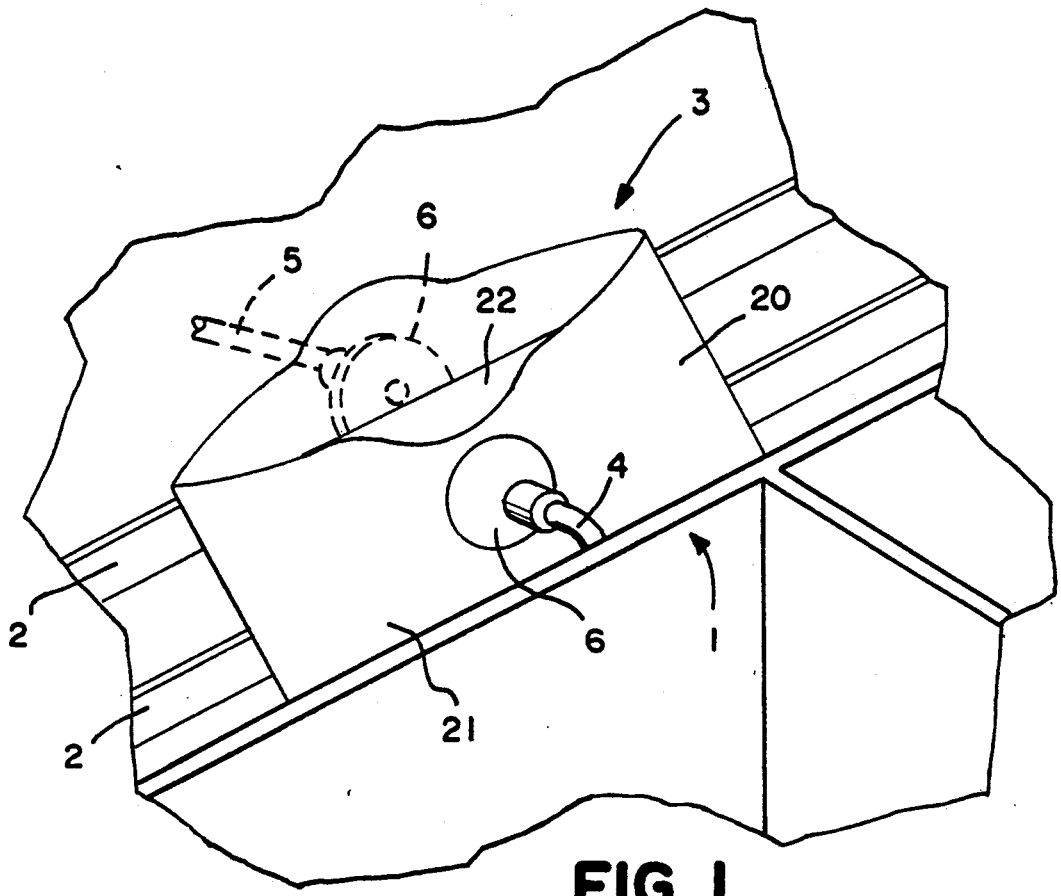
FIG. 1 is a partial, perspective view of a reciprocating suction arm mechanism produced in accordance with the present invention.

FIG. 1 generally illustrates components of a suction arm assembly 1 which has been modified in accordance with the present invention. As is conventional, the suction arm assembly 1 is associated with a transport 2 for conveying envelopes 20 to and from the point (shown at 3) at which the envelopes 20 are to be spread open for extraction purposes. A variety of known mechanisms are available for this purpose, and will depend upon the specific mail extraction device with which the suction arm assembly 1 is associated.

The suction arm assembly 1 generally includes a pair of suction arms 4, 5 positioned on opposite sides of the transport 2, at the extraction point 3. Ends of the suction arms 4, 5 are provided with suction cups 6 for engaging faces 21 of the envelope 20 to be opened, in conjunction with an applied air flow developed by an appropriate vacuum supply system.

Figure 2:
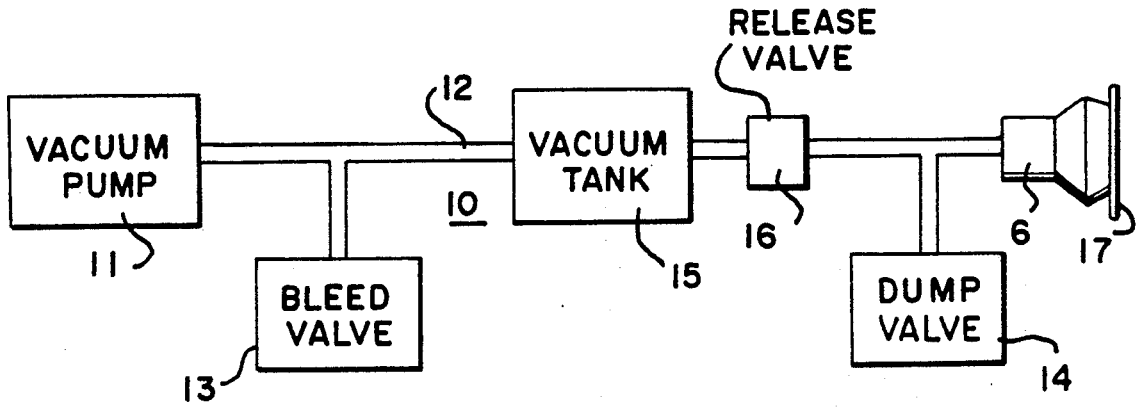
FIG. 2 is a schematic view of the vacuum supplying system for the suction arm mechanism illustrated in FIG. 1.

FIG. 2 schematically illustrates one such vacuum supply system 10, which generally includes a vacuum pump 11 for communicating with the suction arms 4, 5 via the vacuum line 12. A bleed valve 13 is provided to regulate the negative pressure developed within the system, and a dump valve 14 is provided for releasing engaged envelope faces following a completed extraction cycle. Further discussion of the operation of these components will be provided below. However, it should be noted that to this point the disclosed components are entirely conventional in nature, forming a part of any of a variety of commercially available mail extraction devices.

In operation, vacuum developed by the vacuum pump 11 is delivered to the suction arms 4, 5, eventually drawing ambient air through the suction cups 6 of the suction arm assembly 1. Following the transport of an envelope 20 to the extraction point 3, prior practice was to mechanically move the suction arms 4, 5 together until the faces 2 of the stationed envelope 2 were engaged by the opposing suction cups 6 of the suction arm assembly 1. The applied vacuum would then operate to engage the faces 21 of the envelope 20, so that upon retraction of the suction arms 4, 5, the faces 21 of the envelope 20 would be spread open to expose any contents 22 for extraction.

While operating to effectively separate the faces of an envelope for the extraction of contents, the intimate contact developed between the suction cups 6 of the suction arms 4, 5 and the faces 21 of the envelope 20 served to promote so-called "bleed through", which could at times cause the entrainment of contents 22 of the envelope 20 against one or more of the envelope's faces 21 due to the inherent porosity of the paper forming the envelope. Previously, it was common practice to minimize this by adjusting the bleed valve 13 to develop a constant vacuum which was marginally sufficient to engage the faces of an envelope, without also engaging contents of the envelope. However, while improving the overall result, the problem of bleed through nevertheless persisted.

In accordance with the present invention, steps are taken to overcome this by significantly (by at least tenfold) increasing the air flow drawn by the suction cups 6 when the suction arms 4, 5 are moved into proximity with the opposing faces 21 of the envelope 20 to be opened. This operates to develop a low pressure area adjacent to the faces 21 of the envelope 20, which in turn operates to drawn the faces 21 of the envelope 20 to the suction cups 6. This then eliminates the need to have to advance the suction arms 4, 5 into contact with one another, and the interposed envelope 20, avoiding the potential for bleed through to the contents 22 of the envelope.

One, relatively direct means for providing this increased air flow is to simply increase the air supply drawn by the vacuum pump 11. However, while developing the increased air flow which is desired, this has the corresponding disadvantage of requiring the use of a vacuum pump 11 which is significantly increased in size, and cost.

Consequently, as an alternative it is preferred to make use of a vacuum pump 11 of otherwise conventional size, in conjunction with a storage tank 15 and a release valve 16 which are associated with the vacuum line 12 to develop the increased air flow which is desired. To this end, during movement of the suction arms 4, 5 toward the envelope 20, the valve 16 will be closed so that a vacuum is accumulated within the storage tank 15. By opening the valve 16 (which is placed in series with the storage tank 15) just prior to closure of the suction arms 4, 5 over the envelope 20, this stored vacuum is released to develop the increase in air flow which is desired in accordance with the present invention. Activation of the valve 16 can be accomplished either in timed relation to movement of the suction arms 4, 5, or responsive to mechanical or optical position sensing equipment associated with the suction arms 4, 5, as desired. Following capture of the faces 21 of the envelope 20, an adequate vacuum is maintained and made available to the suction cups 6 to hold each engaged envelope face 21 during retraction of the suction arms 4, 5.

FIGS. 3 to 6 further illustrate such operations, as follows. FIG. 3 illustrates components of the suction arm assembly 1 at rest. In this position, the suction arms 4, 5 are fully retracted to receive an envelope between them, in otherwise conventional fashion. Referring now to FIG. 4, upon detecting the presence of an envelope 20 between the suction arms 4, 5, using techniques which are in themselves known, steps are taken to advance the suction arms 4, 5 so that the suction arms 4, 5 are caused to approach the envelope 20 from opposite sides. During this advancement, steps are either taken to develop a fixed, yet increased air flow at the suction cups 6, or to store vacuum within the tank 15 (by closing the valve 16) to prepare for the increased air flow which will soon be required.

When the suction arms 4, 5 come in proximity to the stationed envelope (generally on the order of one-eighth of an inch to near zero), reaching a position such as is illustrated in FIG. 4 of the drawings, an increased air flow is made available which is sufficient to capture the faces 21 of the envelope 20, yet insufficient to also entrain the documents which are contained by the envelope. This increase in air flow may result either from the increased vacuum which is then being drawn by the (enlarged) vacuum pump, or by developing a "burst" of air flow by opening the valve 16 and releasing the vacuum which is then stored by the tank 15.

At this point, it would then be possible to retract the suction arms 4, 5 to the position illustrated in FIG. 3, exposing contents of the envelope for extraction. However, it has been found that this does not always ensure the degree of reliability which is needed for an automated mail extraction procedure. Rather, in some cases the developed air flow will not be sufficient to positively engage the faces 21 of the envelope 20 at the extraction point 3. This is particularly so when handling envelopes having stiffened regions such as are produced by stamps, mailing labels and formed seams, as well as envelopes having open mailing windows. For this reason, it is preferred to make use of suction cups 6 which are of the bellows type, which are presently available from manufacturers such as the Vi-Cas Manufacturing Company, Inc. of Cincinnati, Ohio (e.g., their model VC-B2), and to further operate the suction arms 4, 5 as is best illustrated in FIGS. 5 and 6 of the drawings.

Referring now to FIG. 5, it is seen that following the entrainment of an envelope face 21, the bellows type suction cup 6 will tend to collapse responsive to the vacuum which is then being developed, either directly or through the intermediary of the vacuum tank 15. This will in turn cause a slight retraction of the leading face 17 of each suction cup 6. This then permits limited additional forward travel of the suction arms 4, 5, beyond that illustrated in FIG. 4 of the drawings, without causing actual contact between the opposing suction cups 6 of the suction arm assembly 1.

Ordinarily, this will operate to preserve the desired end result, that being the entrainment of the envelope's faces without direct contact between the suction cups (which would tend to contribute to bleed through), provided the suction cups 6 are sufficiently supple to collapse at a rate faster than the rate of advancement of the suction arms 4, 5. However, in the event that the increased air flow developed as previously described does not operate to effectively engage either or both of the envelope's faces, this same additional forward travel will cause the then-extended leading edges 17 of the bellows-type suction cups 6 to come into contact with the envelope 20 then located at the extraction point 3, and one another. This operates to ensure an effective engagement of the faces 21 of the envelope 20, ensuring that the envelope 20 is opened for the extraction of contents. While it is then possible for bleed through to occur, this possibility will arise only in connection with that small percentage of situations in which the envelope's faces were not effectively entrained by the increased air flow which is developed in accordance with the present invention. Thus, an effective opening of envelopes is ensured with only a minimal potential for bleed through to entrain contents of the opened envelope.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A method for spreading open an envelope which has been severed along at least one edge, by a pair of suction arms disposed on opposite sides of said envelope, comprising the steps of:

advancing the suction arms toward said envelope;

drawing an air flow through said suction arms which is sufficient to draw faces of the envelope to said suction arms prior to contact of said suction arms with said envelope and each other; and retracting said suction arms and said envelope faces, spreading open said envelope.

2. The method of claim 1 wherein said air flow is provided on a substantially continuous basis.

3. The method of claim 2 wherein said suction arms include collapsible suction cups for engaging said envelope faces, and wherein said method additionally includes the steps of collapsing said suction cups following engagement of said envelope faces, and further advancing the suction arms toward one another so that engaged envelope faces remain separated from one another, and unengaged envelope faces are engaged between said opposing suction arms following said further advancing.

4. The method of claim 1 wherein said air flow is provided by:

storing a vacuum in a vacuum tank as said suction arms are advanced toward said envelope; and releasing the stored vacuum prior to contact of said suction arms with said envelope and each other, to develop the air flow through said suction arms to draw the faces of the envelope to said suction arms.

5. The method of claim 4 wherein said suction arms include collapsible suction cups for engaging said envelope faces, and wherein said method additionally includes the step of collapsing said suction cups following engagement of said envelope faces, partially separating said engaged envelope faces from one another.

6. The method of claim 5 which additionally includes the step of further advancing the suction arms toward one another, following said releasing of the stored vacuum.

7. The method of claim 6 wherein engaged envelope faces remain separated from one another following said further advancing.

8. The method of claim 6 wherein unengaged envelope faces are engaged between said opposing suction arms following said further advancing.

9. The method of claim 4 wherein said suction arms are advanced into proximity with said envelope faces prior to said releasing of the stored vacuum.

10. The method of claim 9 wherein said suction arms are advanced to from one-eighth of an inch to near zero relative to said envelope faces prior to said releasing of the stored vacuum.

11. An apparatus for spreading open an envelope which has been severed along at least one edge, comprising:

a pair of suction arms disposed on opposite sides of said envelope and movable toward and away from said envelope to be opened; and means for drawing an air flow through said suction arms which is sufficient to draw faces of said envelope to said suction arms prior to contact of said suction arms with said envelope and each other.

12. The apparatus of claim 11 wherein said suction arms include collapsible suction cups for engaging said envelope faces.

13. The apparatus of claim 12 wherein said collapsible suction cups are bellows-type suction cups.

14. The apparatus of claim 12 wherein said suction cups collapse responsive to engagement of an envelope face.

15. The apparatus of claim 14 wherein said suction arms remain separated from one another following the engagement of said envelope faces.

16. The apparatus of claim 14 wherein said suction arms are moved into contact with said envelope faces responsive to an unsuccessful engagement of said envelope faces.

17. The apparatus of claim 11 wherein said means for drawing an air flow is a vacuum pump for developing said air flow on a substantially continuous basis.

18. The apparatus of claim 11 wherein said means for drawing an air flow includes a vacuum pump for supplying a vacuum, storage means in communication with said vacuum pump and said suction arms for storing said vacuum, and a valve connecting said storage means and said suction arms for selectively releasing said vacuum to draw said air flow through said suction arms.

* * * * *